US009127587B2

(12) United States Patent
Chellan et al.

(10) Patent No.: US 9,127,587 B2
(45) Date of Patent: Sep. 8, 2015

(54) COOLING SYSTEM FOR AN ENGINE AND METHOD OF PROVIDING A COOLING SYSTEM FOR AN ENGINE

(75) Inventors: Gokulnath Chellan, Bangalore (IN); Hemant Patni, Bangalore (IN); Prasannkumar Adimurti, Bangalore (IN); Drew Johnson, Erie, PA (US)

(73) Assignee: General Electric Company, Schenectady, NY (US)

( * ) Notice: Subject to any disclaimer, the term of this patent is extended or adjusted under 35 U.S.C. 154(b) by 772 days.

(21) Appl. No.: 12/956,885

(22) Filed: Nov. 30, 2010

(65) Prior Publication Data

US 2012/0131946 A1 May 31, 2012

(51) Int. Cl.

| | |
|---|---|
| ***F25D 17/02*** | (2006.01) |
| ***B60H 1/32*** | (2006.01) |
| ***F01P 7/14*** | (2006.01) |
| ***F01P 11/02*** | (2006.01) |

(52) U.S. Cl.

CPC ..... *F01P 11/0276* (2013.01); *Y10T 29/49359* (2015.01)

(58) Field of Classification Search

USPC ..... 62/434, 239, 241; 123/41.08–41.09, 123/41.14

See application file for complete search history.

(56) References Cited

U.S. PATENT DOCUMENTS

| | | | | |
|---|---|---|---|---|
| 3,653,430 | A * | 4/1972 | Kinast | 165/134.1 |
| 3,729,020 | A | 4/1973 | Koci | |
| 4,458,523 | A | 7/1984 | Moyer | |
| 4,676,206 | A * | 6/1987 | DeGrazia, Jr. | 123/196 S |
| 5,105,653 | A | 4/1992 | Konter | |
| 5,275,200 | A * | 1/1994 | Yamamoto | 137/377 |
| 5,415,147 | A * | 5/1995 | Nagle et al. | 123/563 |
| 6,196,167 | B1 | 3/2001 | Marsh | |
| 6,227,038 | B1 | 5/2001 | Blossfeld et al. | |
| 7,131,403 | B1 * | 11/2006 | Banga et al. | 123/41.31 |
| 7,165,442 | B2 | 1/2007 | Cryer et al. | |

FOREIGN PATENT DOCUMENTS

| | | | |
|---|---|---|---|
| DE | 3506213 | A1 | 7/1985 |
| DE | 202004016198 | U1 | 12/2004 |
| EP | 0122551 | A2 | 10/1984 |
| GB | 2409262 | A | 6/2005 |
| JP | 57120715 | U | 7/1982 |
| KR | 2001295649 | A | 10/2001 |

OTHER PUBLICATIONS

Search Report and Written Opinion from corresponding PCT Application No. PCT/US2011/057984 dated Dec. 16, 2011.

* cited by examiner

*Primary Examiner* — Frantz Jules
*Assistant Examiner* — Joseph Trpisovsky
(74) *Attorney, Agent, or Firm* — GE Global Patent Operation; John A. Kramer

(57) ABSTRACT

A cooling system for an engine includes a coolant tank, a heat exchanger, and a drain valve. The coolant tank holds a fluid coolant and is coupled with a tank conduit through which the coolant flows from or to the coolant tank. The heat exchanger is fluidly coupled with a supply conduit. The drain valve is fluidly coupled with the coolant tank by the tank conduit and with the supply conduit. The drain valve is fluidly coupled with a drain conduit that directs the coolant out of the cooling system and alternates between a closed position and an open position. The drain valve prevents the coolant from flowing out of the cooling system through the drain conduit when in the closed position and permits the coolant to flow from the heat exchanger and out of the cooling system through the drain conduit when in the open position.

15 Claims, 8 Drawing Sheets

COOLING SYSTEM FOR AN ENGINE AND METHOD OF PROVIDING A COOLING SYSTEM FOR AN ENGINE

BACKGROUND

The subject matter described herein relates to cooling systems, such as cooling systems for engines.

Known vehicles include cooling systems that reduce temperatures of engines in the vehicles to prevent the engines from overheating. For example, rail vehicles such as diesel engine locomotives and other vehicles may include cooling systems that cool the engines when the engines are operating to move the vehicles. Some known cooling systems include tanks that hold a liquid coolant and radiators that are fluidly coupled with the tanks. For example, radiators of a diesel engine may be coupled with a tank by one or more hoses.

In order to cool the engine, the coolant is pumped from the tank, by or through the engine, and to the radiator. More specifically, from the tank, the coolant flows by or through the engine, where thermal energy generated by the engine is transferred to the coolant. In certain operational modes, the coolant is passed to the radiator, where thermal energy of the coolant is transferred to ambient (e.g., air passing through the radiator). The coolant may return to the tank. Due to changing temperatures, degradation, and other causes, one or more components and/or interfaces of the cooling system can be damaged. For example, hoses can crack and seals between the hoses and the tank or radiator can be compromised by freezing and thawing of coolant. The cracks and/or compromised seals may allow coolant to leak from the cooling system and not flow through the cooling system to cool the engine.

In some know locomotives, the cooling system is tested for leaks using a "squeeze test." During the squeeze test, an operator opens a vent to the radiators of the cooling system and fills the radiators and cooling system with more coolant. The operator closes the vent, and the cooling system is activated to pump the coolant throughout the cooling system. The operator then visually inspects for leaks around or below the cooling system.

The vents used by the operators to fill the cooling system with coolant are not easily accessible. The vents may be located above the radiators at the top of the locomotive cab, which can be four meters high or higher. As a result, the operator may need to be lifted above the locomotive by a crane or other device to reach the vent. As not all repair stations for locomotives have such cranes, some repair stations may be unable to perform the squeeze test to check for leaks in the cooling system. Moreover, lifting and lowering the operator takes additional time.

It may be desirable to have a cooling system and a method for providing a cooling system for an engine that more easily accessible by operators and/or reduces the time required to inspect for leaks of the cooling system.

BRIEF DESCRIPTION

In accordance with one embodiment, a cooling system for an engine is provided. The cooling system includes a coolant tank, a heat exchanger, and a drain valve. The coolant tank is configured to hold a fluid coolant and is coupled with a tank conduit through which the coolant flows from or to the coolant tank. The heat exchanger is fluidly coupled with a supply conduit. The drain valve is fluidly coupled with the coolant tank by the tank conduit and with the heat exchanger by the supply conduit. The drain valve is fluidly coupled with a drain conduit that directs the coolant out of the cooling system and is configured to alternate between a closed position and an open position. The drain valve prevents the coolant from flowing out of the cooling system through the drain conduit when the drain valve is in the closed position and permits the coolant to flow from the heat exchanger and out of the cooling system through the drain conduit when the drain valve is in the open position.

In another embodiment, a method of providing a cooling system for an engine is provided. The method includes fluidly coupling a drain valve with a coolant tank that is capable of holding a fluid coolant and fluidly coupling the drain valve with a heat exchanger. The method further includes fluidly coupling the drain valve with an outlet for directing the coolant away from the coolant tank and the heat exchanger. The drain valve is configured to alternate between a closed position and an open position. The drain valve prevents the coolant from flowing to the outlet when the drain valve is in the closed position and permits the coolant to flow from the heat exchanger to the outlet when the drain valve is in the open position.

In another aspect, a method of testing for a leak in a cooling system of an engine is provided. The method includes actuating a drain valve that is fluidly coupled with a coolant tank, a heat exchanger, and an outlet that directs a coolant out of the cooling system. The drain valve may be actuated to open a discharge flow path that fluidly couples the heat exchanger and the outlet. The method also includes loading the coolant into the coolant tank until at least some of the coolant is discharged from the heat exchanger and through the discharge flow path to the outlet and actuating the drain valve to close the discharge flow path. The method also includes inspecting the cooling system for one or more leaks of the coolant.

BRIEF DESCRIPTION OF THE DRAWINGS

The present invention will be better understood from reading the following description of non-limiting embodiments, with reference to the attached drawings, wherein below.

DETAILED DESCRIPTION

The subject matter described herein relates to cooling systems for engines, methods for retrofitting cooling systems for engines, and methods of testing for leaks in such cooling systems. The cooling systems may be used to cool the engines of vehicles, such as the engines of locomotives in rail vehicles. Not all embodiments are limited to the engines of rail vehicles or of vehicles. For example, one or more embodiments may be used to provide cooling systems for other vehicles or other devices.

Figure 1:
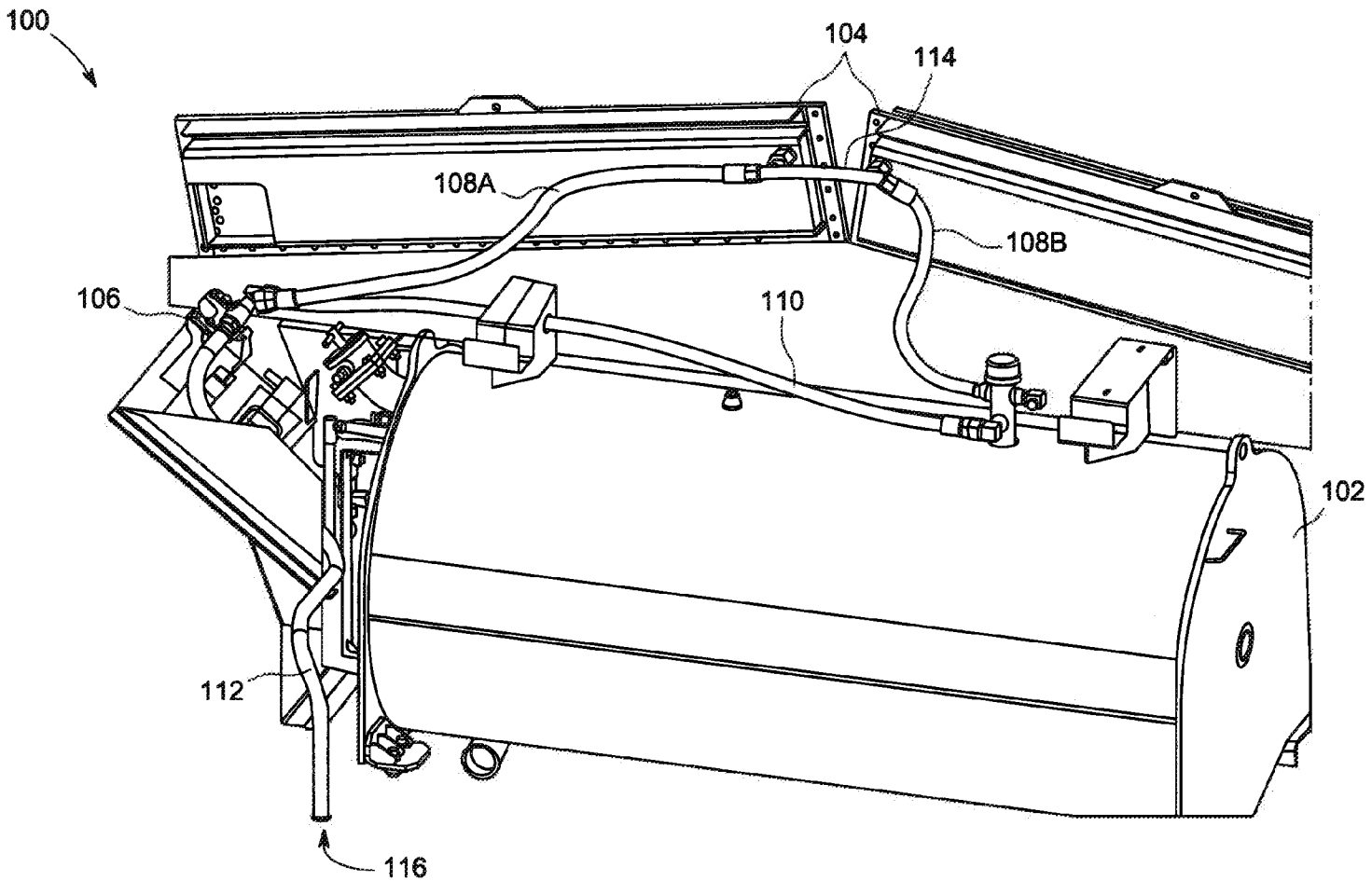
FIG. 1 is a perspective view of a cooling system in accordance with one embodiment.

FIG. 1 is a perspective view of a cooling system 100 in accordance with one embodiment. The cooling system 100 includes a coolant tank 102 that holds a fluid coolant. For example, the coolant tank 102 may be a container that stores a liquid such as water. The coolant tank 102 is fluidly coupled with heat exchangers 104. In the illustrated embodiment, two heat exchangers 104 are included in the system 100. Alternatively, a single heat exchanger 104 or three or more heat exchangers 104 are provided. The cooling system 100 supplies coolant to an engine 200 (shown in FIG. 2) to reduce the temperature of the engine 200. The temperature of the coolant is increased after cooling the engine 200. The heated coolant is passed to the heat exchangers 104, where the heat exchangers 104 reduce the temperature of the coolant. For example, the heat exchangers 104 may be radiators disposed near a fan that blows air across the heat exchangers 104. The passage of air across the heat exchangers 104 can remove thermal energy, or heat, from the coolant and reduce the temperature of the coolant.

The coolant tank 102 and the heat exchangers 104 are fluidly coupled with each other by a drain valve 106 and several conduits 108, 110, 112, 114 in the illustrated embodiment. The conduits 108, 110, 112, 114 may be provided as hoses or other channels that direct flow of the coolant through the system 100. The conduits 108 are collectively labeled 108 and are individually labeled 108A and 108B.

In the illustrated embodiment, the conduit 108A fluidly couples one of the heat exchangers 104 with the drain valve 106 and the conduit 108B fluidly couples the other heat exchanger 104 with the coolant tank 102. The conduit 114 fluidly couples the heat exchangers 114 with each other. The conduits 108A and 108B are referred to as "radiator conduits 108" and the conduit 114 is referred to as an "intervening conduit 114." Alternatively, a different number of the radiator conduits 108 and/or the intervening conduit 114 may be provided. The conduit 108A that fluidly couples one of the heat exchangers 104 with the drain valve 106 may be referred to as a supply conduit.

The conduit 110 is referred to as a "tank conduit 110." The tank conduit 110 fluidly couples the coolant tank 102 with the drain valve 106. While a single tank conduit 110 is shown, alternatively a greater number of tank conduits 110 may be provided and/or the tank conduit 110 may be joined with other conduits to fluidly couple the coolant tank 102 and the drain valve 106.

The conduit 112 is referred to as a "drain conduit 112." The drain conduit 112 fluidly couples the drain valve 106 with an outlet 116 of the system 100. While a single drain conduit 112 is shown, alternatively a greater number of drain conduits 112 may be provided and/or the drain conduit 112 may be joined with other conduits to fluidly couple the drain valve 106 with the outlet 116. The outlet 116 is a vent or other discharge port that directs coolant out of the cooling system 100 and away from the coolant tank 102 and/or the heat exchangers 104. For example, when the drain valve 106 is moved to an open position to fluidly couple the heat exchangers 104 with the drain conduit 112 via the drain conduit 112, at least some of the coolant may flow through from the heat exchangers 104 and through the drain valve 106 to the drain conduit 112 and out of the system 100 through the outlet 116. The outlet 116 may be disposed on an exterior surface of the rail vehicle 300 (shown in FIG. 3) to discharge the coolant out of the rail vehicle 300 in one embodiment. The outlet 116 may comprise a distal end (the end opposite the drain valve) of the drain conduit 112.

One or more components of the cooling system 100 may be provided as a retrofit kit or assembly. The retrofit kit can be added to existing components of a cooling system. For example, the retrofit kit may include the drain valve 106 and one or more conduits, such as the intervening conduit 114 and the tank conduit 110. The intervening conduit 114 may be coupled with existing radiator conduits 108 and the drain valve 106. The drain valve 106 may be coupled with the tank conduit 110 and the tank conduit 110 may be coupled with the coolant tank 102 to provide the cooling system 100 shown in FIG. 1.

Figure 2:
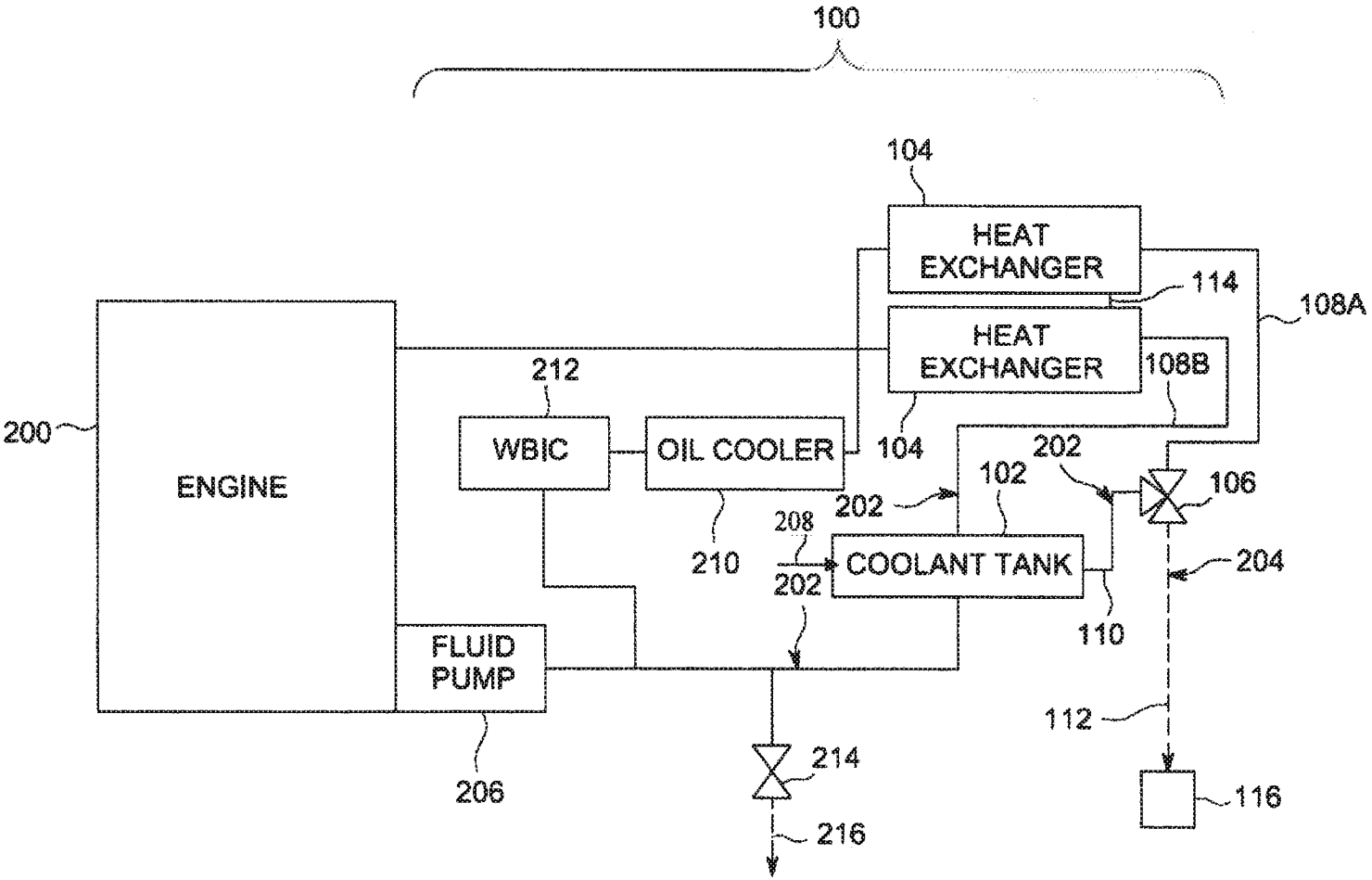
FIG. 2 is a fluid circuit diagram of the cooling system shown in FIG. 1 in accordance with one embodiment.

FIG. 2 is a fluid circuit diagram of the cooling system 100 in accordance with one embodiment. The heat exchangers 104 of the cooling system 100 may be disposed at or near a fan (not shown) in order to dissipate thermal energy or heat of the coolant as the coolant passes through the heat exchangers 104. Only one of the heat exchangers 104 is shown in FIG. 2. Additional heat exchangers 104 may be fluidly coupled with other components of the cooling system 100 similar to the illustrated heat exchanger 104.

The drain valve 106 is a three-way valve in one embodiment. Alternatively, the drain valve 106 may be a valve other than a three-way valve and/or may be a combination of several valves. The drain valve 106 moves between different positions to open different flow paths through the conduits 108, 110, 112, 114 (shown in FIG. 1). The various flow paths are illustrated as lines that interconnect the components of the system 100 in FIG. 2. For example, in a closed position, the drain valve 106 may fluidly couple the tank conduit 110 with the supply conduit 108A and the radiator conduits 108 to create a first flow path 202 that extends between the coolant tank 102 and the heat exchangers 104.

In the illustrated embodiment, the coolant flows from the coolant tank 102 to a fluid pump 206 that is joined to the engine 200. The coolant passes through and/or around the engine 200 from the pump 206 (e.g., the coolant may flow through cooling passages located proximate combustion cylinders of the engine). The pump 206 is provided to move the coolant from the coolant tank 102 to the engine 200. The coolant may then flow from the engine 200 (or pump 206) to the heat exchangers 104 and/or additional cooling mechanisms, such as an oil cooler 210 and/or a water based inter cooler (WBIC) 212. As shown in FIG. 2, the coolant can flow in the first flow path 202 that forms at least part of a loop that fluidly couples the coolant tank 102, the pump 206, and the heat exchangers 104. As shown in FIG. 2, in one embodiment, the first flow path 202 may bypass the drain conduit 112 and the drain valve 106. Although one pump is shown in association with the engine, alternatively, a different number of pumps 206 may be provided and/or the pump 206 may be disposed elsewhere along the supply flow path 202.

The drain valve 106 is fluidly coupled with the heat exchangers 104, the coolant tank 102, and the outlet 116. As shown in FIG. 2, the drain valve 106 is fluidly coupled with the heat exchangers 104 by the radiator conduit 108A, with the coolant tank 102 by the tank conduit 110, and with the outlet 116 by the drain conduit 112 (shown in dashed line in FIG. 2). When the drain valve 106 is in a closed position, the drain valve 106 closes the drain conduit 112 and prevents coolant from flowing to the outlet 116 via the drain conduit 112 in one embodiment. When the drain valve 106 is moved to an open position, the drain valve 106 fluidly couples the heat exchangers 104 with the drain conduit 112 to create a second flow path 204. The second flow path 204 fluidly couples the drain valve 106 with the outlet 116. Coolant may be discharged from the system 100 by flowing out of the outlet 116 through the discharge flow path 204. In one embodiment, the drain valve 106 may close off the tank conduit 110 when the drain valve 106 is in an open position such that coolant cannot flow into the tank conduit 110.

In one embodiment, the drain valve 106 keeps the first flow path 202 open when the drain valve 106 is in the open position or closed position. For example, the drain valve 106 may be a three-way valve that opens or closes the second flow path 204 while the first flow path 202 remains open. The first flow path 202 may remain open regardless of the position of the drain valve 106 in order to prevent the first flow path 202 from being inadvertently closed such that the coolant cannot be supplied to the heat exchangers 104. Conversely, the second flow path 204 can be opened or closed to prevent flow of the coolant through the drain conduit 112 by closing the drain valve 106.

During operation of the engine 200, such as when the rail vehicle 300 (shown in FIG. 3) is propelling itself along one or more rails, the drain valve 106 may be in the closed position. As a result, the second flow path 204 is closed. (The first flow path 202 is open, as a function of drain valve position, or, in another embodiment, the first flow path 202 is always open.) Coolant flows from the coolant tank 102 to the heat exchangers 104 at least partially through the first flow path 202. The pump 206 may assist in moving the coolant through the first flow path 202.

As shown in FIG. 2, the cooling system 100 may include an additional system valve 214 that is fluidly coupled with the first flow path 202. The system valve 214 is coupled with a system drain conduit 216. The system valve 214 alternates between closed and open positions to prevent or allow the coolant from flowing out of the cooling system 100 through the system drain conduit 216. The system drain conduit 216 may extend to an external vent or other outlet to direct coolant out of the cooling system 100. During operation of the cooling system 100 or when a leak test is performed on the cooling system 100, the system valve 214 is closed to permit the coolant to flow along the first flow path 202 but prevent coolant from flowing out of the system drain conduit 216. In order to drain the coolant from the cooling system 100, the system valve 214 can be moved to an open position to fluidly couple the system drain conduit 216 with the first flow path 202. As a result, all or substantially all of the coolant may flow out of the cooling system 100 through the system valve 214 and the system drain conduit 216.

An operator of the vehicle that includes the cooling system 100 may inspect the cooling system 100 for leaks. For example, the operator may stop the rail vehicle 300 and deactivate the engine 200 before performing a leak test to determine if coolant is leaking from one or more of the conduits 108, 110, 112, 114, the heat exchangers 104, the coolant tank 102, the drain valve 106, and/or one or more interfaces therebetween. In one embodiment, the cooling system 100 is inspected for one or more leaks by moving the drain valve 106 to the open position to open the second flow path 204 to the outlet 116. Coolant may drain out of the heat exchangers 104 through the radiator conduits 108, the intermediate conduit 114, the drain valve 106, and the drain conduit 112. Additional coolant is then loaded into the coolant tank 102. For example, the coolant tank 102 may include an inlet 208 that permits additional coolant to be loaded into the interior of the coolant tank 102.

The inlet 208 may be opened and additional coolant loaded into the coolant tank 102 through the inlet 208. The additional coolant is loaded into the coolant tank 102 until at least some of the coolant flows up through the tank conduit 110 and out of the cooling system 100 through the drain valve 106 and the drain conduit 112. At least some of the excess coolant may be discharged from the cooling system 100 through the outlet 116 (shown in FIG. 1).

The drain valve 106 can be actuated to close the second flow path 204 to the outlet 116. As described above, the first flow path 202 may remain open when the second flow path 204 is open or closed to ensure that the coolant can flow to or through the engine 200 regardless of the position of the drain valve 106. Alternatively, the drain valve 106 may be actuated to open the first flow path 202 and close the second flow path 204.

Once the second flow path 204 is closed, the pressure of the coolant in the cooling system 100 may be increased. For example, additional coolant may be loaded into the cooling system 100 through the inlet 208. The pressure of the coolant may be increased to a predetermined testing pressure. The testing pressure is greater than an operating pressure of the cooling system 100 in one embodiment. For example, the pressure of the coolant in the cooling system 100 may be increased above the pressure at which the coolant flows through the system 100 to the engine 200 when the rail vehicle 300 (shown in FIG. 3) is in operation. The cooling system 100 is in an overpressure condition when the coolant pressure is increased to a pressure that exceeds the pressure during normal operation of the cooling system 100.

In one embodiment, the cooling system 100 is held at the overpressure condition for a predetermined time period. The cooling system 100 may be maintained at the overpressure condition for an extended period of time, such as one to three or four hours, to test the integrity of the cooling system 100. For example, the cooling system 100 can be held at the overpressure condition to test the interfaces or seals between and/or the strength of the conduits 108, 110, 112, 114, heat exchangers 104, pump 206, drain valve 106, and the like.

The cooling system 100 is inspected for leaks. In one embodiment, a pressure gauge is coupled to the cooling system 100 to measure a decrease, or loss, in the coolant pressure in the cooling system 100. The cooling system 100 may be visually inspected with an operator looking for puddles or other discharges of the coolant outside of the cooling system 100. Alternatively, one or more sensors, such as moisture sensors, may be disposed around or near the cooling system 100 to check for leaks of the coolant. After completion of the inspection for leaks, the drain valve 106 may be switched to the open position to again open the second flow path 204 to the outlet 116. The opened second flow path 204 allows excess coolant that is held in the cooling system 100 at the overpressure condition to flow out of the cooling system 100 through the drain conduit 112 and the outlet 116.

Figure 3:
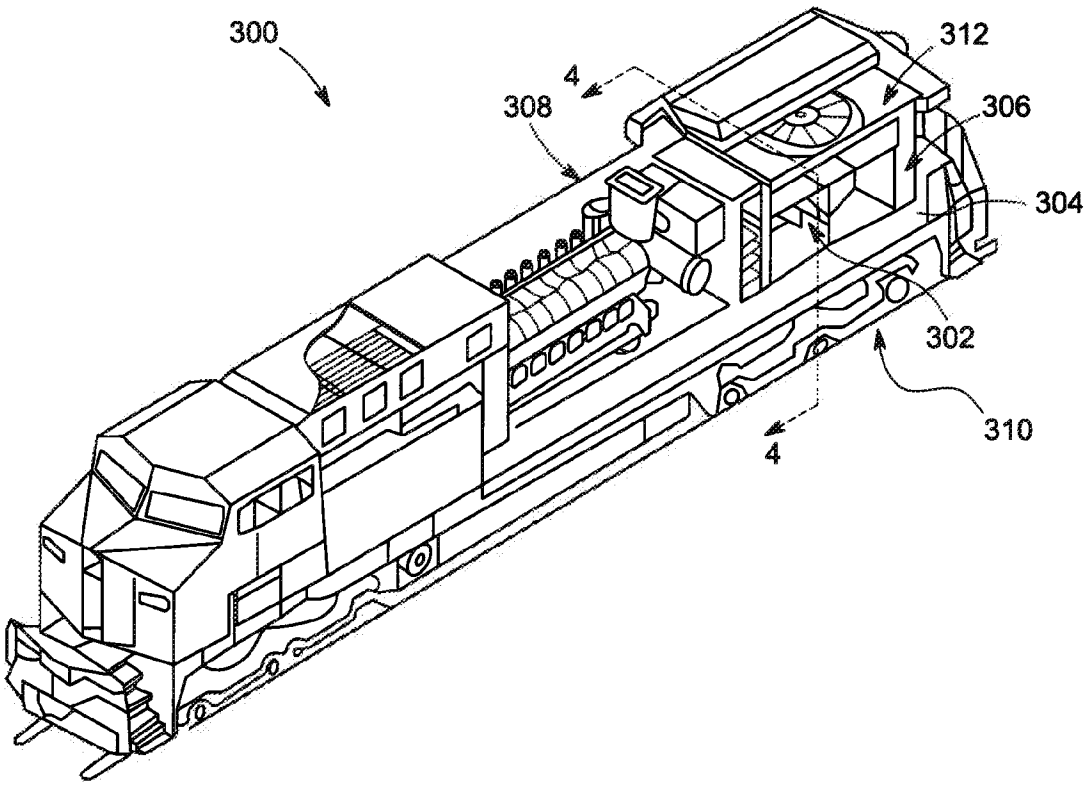
FIG. 3 is a partial cut-away view of a rail vehicle that may include the cooling system shown in FIG. 1 in one embodiment.
Figure 4:
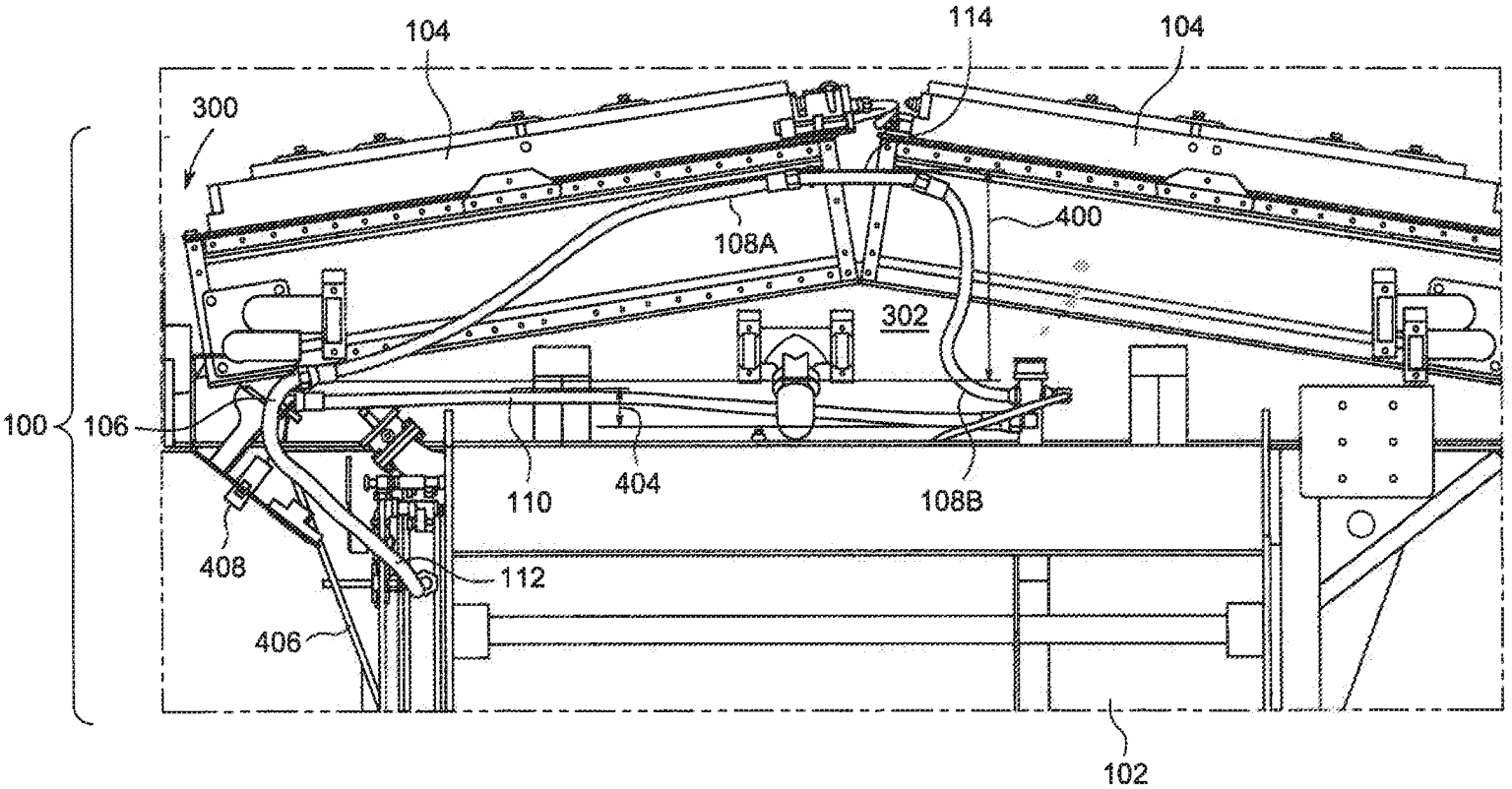
FIG. 4 is a cross-sectional view of the rail vehicle along line 4-4 shown in FIG. 3 in accordance with one embodiment.

FIG. 3 is a partial cut-away view of the rail vehicle 300 that may include the cooling system 100 shown in FIG. 1 in one embodiment. FIG. 4 is a cross-sectional view of the rail vehicle 300 along line 4-4 shown in FIG. 3 in accordance with one embodiment. The cooling system 100 is shown enclosed in an interior compartment 302 of the rail vehicle 300 in FIG. 4. The drain valve 106 is positioned such that a physically average human operator may more easily access the drain valve 106 without assistance from lifting devices such as a crane or ladder. For example, the drain valve 106 may be positioned closer to a lateral side 306 or 308 of the rail vehicle 300. In the illustrated embodiment, the lateral sides 306, 308 represent opposite exterior sides of the rail vehicle 300 that generally extend between a lower side 310 and an upper side 312 of the rail vehicle 300. The upper side 312 represents the side of the rail vehicle 300 that extends over the rail vehicle 300 and generally faces upward. The lower side 310 represents the side of the rail vehicle 300 that faces downward toward the ground or track that the rail vehicle 300 travels along. The drain valve 106 may be accessible through one of the lateral sides 306, 308 rather than the upper side 312 in order to make the drain valve 106 more easily accessible by a human operator.

In one embodiment, an operator walkway 304 extends around at least part of the lateral sides 306, 308. The walkway 304 may be accessible to an operator and at least partially encircle the cooling system 100 and interior compartment 302. In the illustrated embodiment, the heat exchangers 104 of the cooling system 100 are disposed above the coolant tank 102, with the conduits 108, 110, 114 disposed between the heat exchangers 104 and the coolant tank 102. An operator may use steps or a ladder to access the walkway 304, walk along the walkway 304 to the location of the drain valve 106, and access the drain valve 106 while the operator is standing on the walkway 304 without use of additional lifting mechanisms such as additional ladders, steps, or cranes. Alternatively, the drain valve 106 may be positioned lower in the rail vehicle 300 such that the operator can access the drain valve 106 from ground level without use of additional lifting mechanisms.

One or more of the conduits 108, 110, 112, 114 of the cooling system 100 may be positioned to permit the coolant to drain out of the heat exchangers 104 and/or the conduits 108, 110, 114 when the pump 206 is deactivated, such as when the rail vehicle 300 is turned off. For example, the conduits 108, 110, 114 may be pitched so that coolant in the conduits 108, 110, 114 drains to the coolant tank 102 when the pump 206 is not forcing the coolant through the cooling system 100. Failure to drain the coolant from the conduits 108, 110, 112, 114 may permit the coolant to freeze inside the conduits 108, 110, 112, 114 and damage the conduits 108, 110, 112, 114 and/or the interfaces between the conduits 108, 110, 112, 114 and other components of the cooling system 100. The downward pitch of the conduits 108, 110, 114 also may prevent air bubbles or pockets from forming and being trapped in the conduits 108, 110, 114. For example, any such air bubbles or pockets may rise up and out of the conduits 108, 110, 114.

In one embodiment, the radiator conduits 108 are pitched downward from the heat exchangers 104. For example, the conduit 108A can be sloped downward from the heat exchangers 104 toward the drain valve 106 and the radiator conduit 108B can be sloped downward from the heat exchangers 104 toward the coolant tank 102 such that coolant in the conduits 108A, 108B drains toward the drain valve 106 and/or coolant tank 102 when the pump 206 is deactivated. In the illustrated embodiment, the conduits 108 are sloped downward a vertical height dimension 400 of approximately 12 inches, or 30.48 centimeters, from the interfaces between the radiator conduits 108 and the heat exchangers 104 to the interface between the radiator conduits 108 and the intervening conduit 114.

The tank conduit 110 may be pitched downward from the interface with the drain valve 106 to the interface with the pump 206 or coolant tank 102. The tank conduit 110 can be sloped downward such that coolant in the tank conduit 110 drains to the coolant tank 102 when the pump 206 is deactivated. In the illustrated embodiment, the tank conduit 110 is sloped downward a vertical height dimension 404 of approximately 2 inches, or 5.0 centimeters, from the interface between the tank conduit 110 and the drain valve 106 to the interface between the tank conduit 110 and the pump 206. As a result, a total downward slope of the flow path that includes the radiator conduits 108, the intervening conduit 114, the drain valve 106, and the tank conduit 110 (and that extends from the heat exchangers 104 to the coolant tank 102) encompasses a vertical drop dimension of 20 inches, or 50.8 centimeters. Alternatively, one or more of the vertical height dimensions 400, 402, 404 may be different.

In the illustrated embodiment, the rail vehicle 300 includes an exterior wall 406 that at least partially encloses the cooling system 100 within the rail vehicle 300. The exterior wall 406 and one or more other walls of the rail vehicle 300 may include a substantial portion of the cooling system 100 with part of the heat exchangers 104 exposed to the air along the top side of the rail vehicle 300, as shown in FIG. 4. The walkway 304 (shown in FIG. 3) that at least partially extends around the interior compartment 302 also at least partially extends around the exterior wall 406. An access window 408 is provided through the exterior wall 406 that permits an operator to reach into the interior compartment 302 and manually actuate the drain valve 106. For example, the window 408 may be positioned such that a human operator may walk along the walkway 304 to the window 408 and reach into the interior compartment 302 to actuate the drain valve 106. The window 408 may be sufficiently low to the walkway 304 that the operator does not need additional ladders, cranes, or other devices to reach up from the walkway 304 and actuate the drain valve 106 through the window 408. The operator may reach into the interior compartment 302 and actuate the drain valve 106 to switch the drain valve 106 between open and closed positions.

Figure 5A:
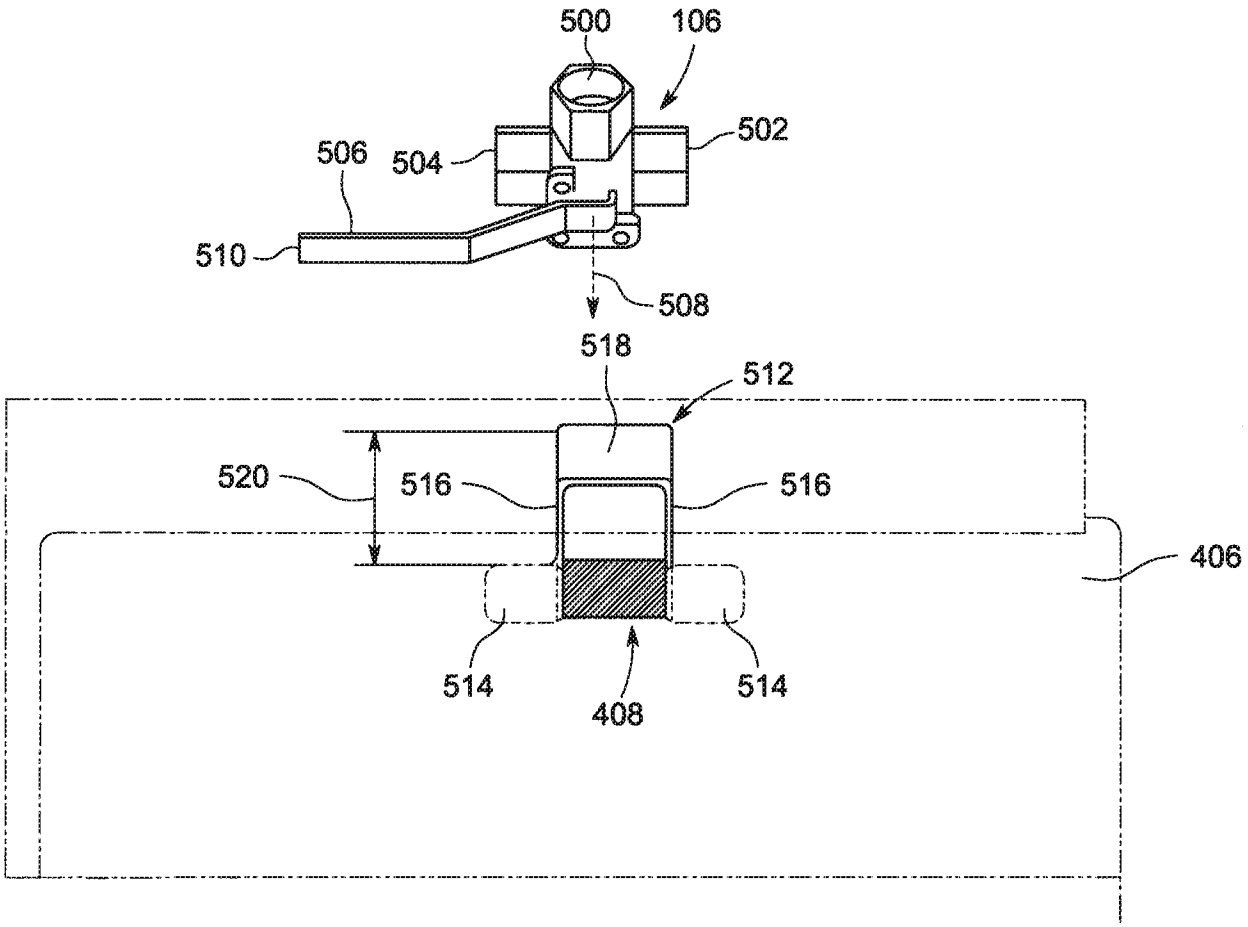
FIG. 5A is a perspective view of the drain valve shown in FIG. 1 in a closed position in accordance with one embodiment.
Figure 5B:
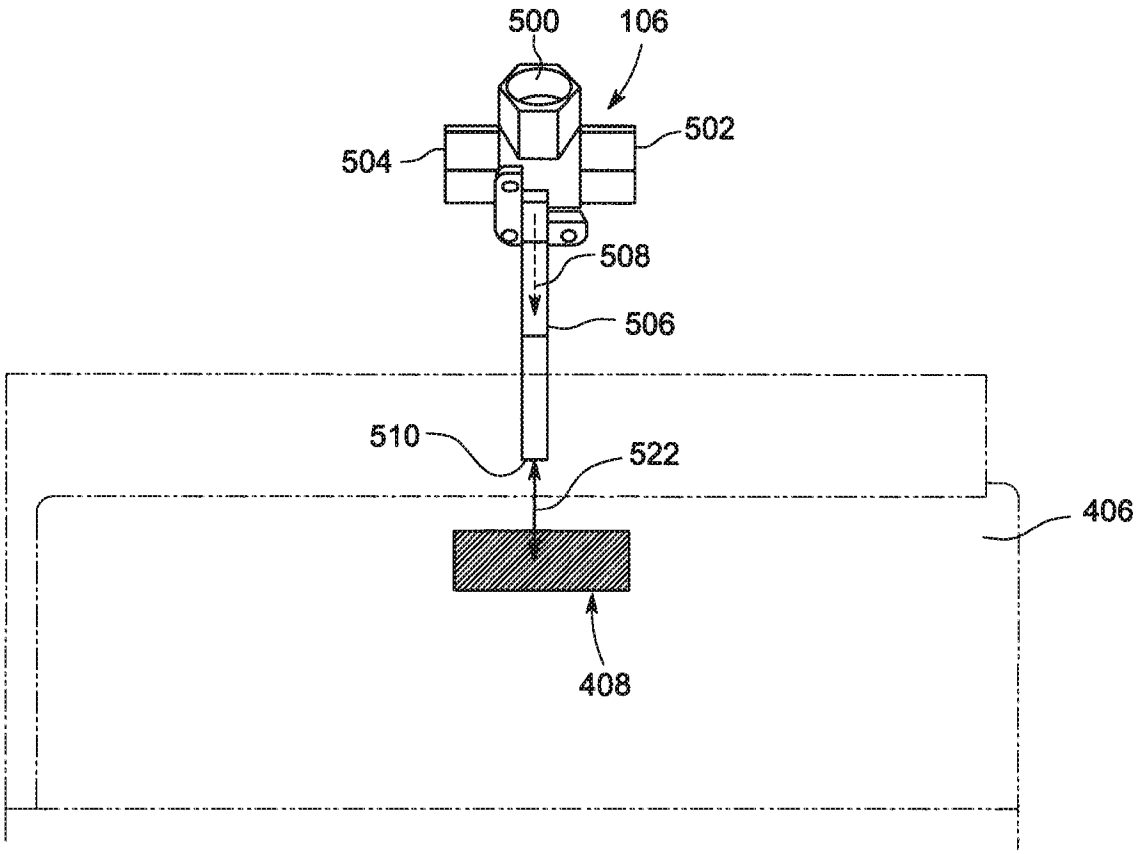
FIG. 5B is a perspective view of the drain valve shown in FIG. 1 in an open position in accordance with one embodiment.

FIG. 5A is a perspective view of the drain valve 106 in a closed position in accordance with one embodiment. FIG. 5B is a perspective view of the drain valve 106 in an open position in accordance with one embodiment. The conduits 110, 112, 114 (shown in FIG. 1) and other components from the cooling system 100 (shown in FIG. 1) are removed from FIGS. 5A and 5B. The drain valve 106 is shown inside the interior compartment 302 (shown in FIG. 3) of the rail vehicle 300 (shown in FIG. 3). The drain valve 106 may be mounted to the exterior wall 406 of the rail vehicle 300 by a bracket or other component that is coupled with the exterior wall 406. For example, the drain valve 106 may be bolted or otherwise affixed to an interior surface of the exterior wall 406.

The drain valve 106 includes several fluid passageways 500, 502, 504 that permit coolant to enter and/or exit the drain valve 106. The fluid passageway 500 can be fluidly coupled with the intervening conduit 114 (shown in FIG. 1) to communicate the coolant between the drain valve 106 and the heat exchangers 104. The fluid passageway 502 can be fluidly coupled with the tank conduit 110 (shown in FIG. 1) to communicate the coolant between the drain valve 106 and the coolant tank 102 (shown in FIG. 1). The fluid passageway 504 can be fluidly coupled with the drain conduit 112 (shown in FIG. 1) to communicate the coolant between the drain valve 106 and the outlet 116 (shown in FIG. 1).

The drain valve 106 includes a handle 506 that is actuated to open or close the drain valve 106 in the illustrated embodiment. The handle 506 rotates about a central axis 508 to open or close the drain valve 106. The handle 506 is elongated and extends from the drain valve 106 to an outer end 510. In the illustrated embodiment, the handle 506 is shown in a position that closes the discharge flow path 204 (shown in FIG. 2). For example, when the handle 510 is oriented away from the exterior wall 406 to which the drain valve 106 is mounted, the drain valve 106 is in an open position.

The drain valve 106 can be enclosed within the interior compartment 302 (shown in FIG. 3) of the rail vehicle 300 (shown in FIG. 3) by inserting an interference bracket 512 into the window 408. The interference bracket 512 is a body that is removably coupled with the exterior wall 406 to at least partially close the window 408 so as to enclose the drain valve 106 in the interior compartment 302. The window 408 provides access to the drain valve 106.

An operator may remove the interference bracket 512 from the exterior wall 406 to open the window 408. Once the interference bracket 512 is removed, the operator may reach into the interior compartment 302 (shown in FIG. 3) and actuate the handle 510, such as rotating the handle 510 about the center axis 508 in a counter-clockwise direction to open the discharge flow path 204 (shown in FIG. 2) when the drain valve 106 is in the open position shown in FIG. 5A or in a clockwise direction to close the discharge flow path 204 when the drain valve 106 is in the closed position shown in FIG. 5B.

In the illustrated embodiment, the interference bracket 512 includes mounting plates 514 that are joined with opposing vertical plates 516. The mounting plates 514 are shown using dashed lines as the mounting plates 514 are disposed on the opposite side of the exterior wall 406 and thereby otherwise blocked from view in FIG. 5A. A cross beam 518 interconnects the vertical plates 516. For example, the mounting plates 514 may be coupled with the vertical plates 516 at one end of each of the vertical plates 516 while the cross beam 518 is coupled with the vertical plates 516 at an opposite end of each of the vertical plates 516. The interference bracket 512 is shown as forming a U or C shape, but alternatively may form another shape.

In one embodiment, the interference bracket 512 is shaped to prevent the drain valve 106 from being enclosed in the interior compartment 302 (shown in FIG. 3) of the rail vehicle 300 (shown in FIG. 3) while the drain valve 106 is in the open position shown in FIG. 5B, or a position that opens the discharge flow path 204 (shown in FIG. 2). For example, the interference bracket 512 can be loaded into the interior compartment 302 through the window 408 to at least partially close the window 408 and enclose the drain valve 106 in the interior compartment 302. The interference bracket 512 is loaded into the interior compartment 302 until the mounting plates 514 engage the outside surface of the exterior wall 406. As the interference bracket 512 is loaded into the interior compartment 302, the vertical plates 516 and cross beam 518 move into the interior compartment 302 and toward the handle 506.

The vertical plates 516 may be sufficiently long to position the cross beam 518 inside the interior compartment 302 (shown in FIG. 3) such that the handle 506 interferes with insertion of the interference bracket 512 when the handle 506 is in the open position shown in FIG. 5B. For example, the vertical plates 516 may be elongated by a length dimension 520. The length dimension 520 represents the distance between the mounting plates 514 and the cross beam 518 in the illustrated embodiment. As shown in FIG. 5B, the handle 506 is displaced away from the window 408 by a separation distance 522 when the handle 506 is in the open position. For example, the outer end 510 may be separated from the plane of the exterior wall 406 that extends through the window 408 by the separation distance 522.

The length dimension 520 of the interference bracket 512 may be longer than the separation distance 522 of the handle 506. As a result, if the handle 506 is left in the open position shown in FIG. 5B when the interference bracket 512 is inserted into the window 408, then the interference bracket 512 strikes or otherwise engages the handle 506 before the interference bracket 512 is loaded into the interior compartment 302 (shown in FIG. 3). For example, the cross beam 518 may engage the outer end 510 of the handle 506 and prevent further insertion of the interference bracket 512 into the interior compartment 302 before the mounting plates 514 engage the exterior wall 406. Consequently, the interference bracket 512 may be unable to be coupled with the exterior wall 406. For example, an operator may be prevented from fully inserting the interference bracket 512 into the window 408 when the drain valve 106 is in the open position shown in FIG. 5B. The operator may then remove the interference bracket 512, rotate the handle 506 to the closed position shown in FIG. 5A, and then fully insert the interference bracket 512 into the window 408. The mounting plates 514 can then be coupled with the exterior wall 406 by fixation devices, such as bolts or screws.

Figure 6:
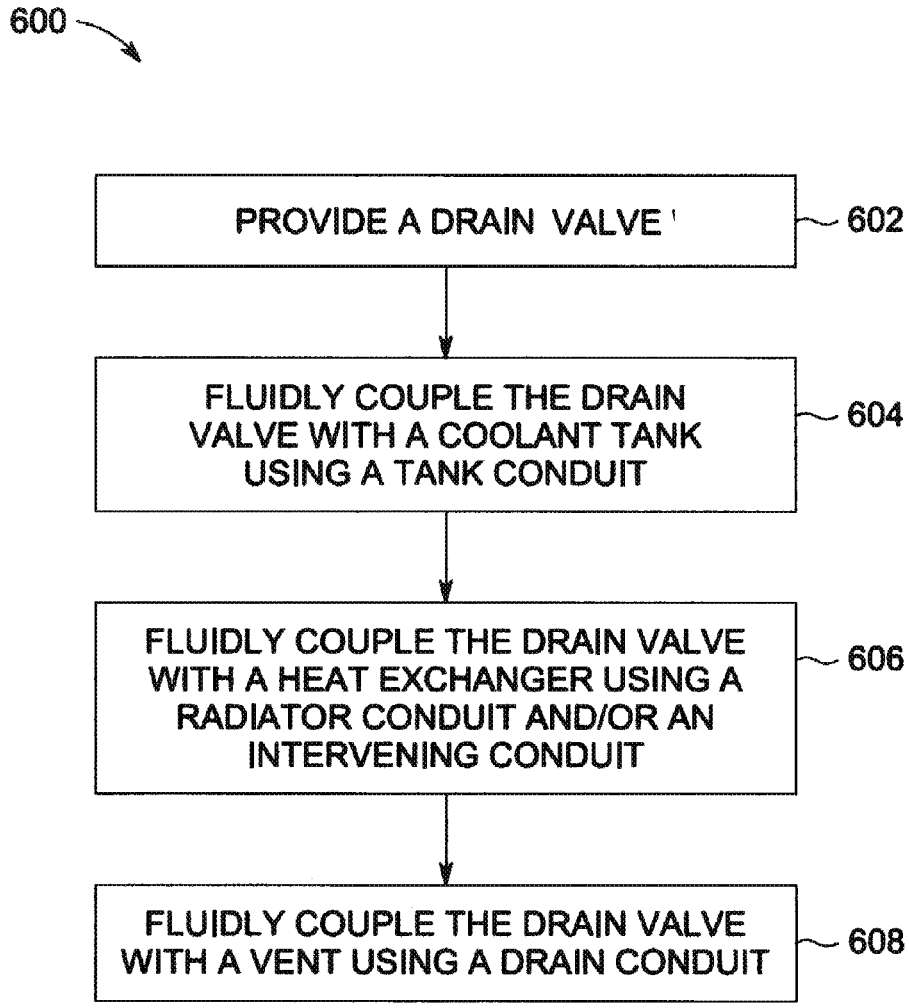
FIG. 6 is a flowchart of a method for providing a cooling system for an engine in accordance with one embodiment.

FIG. 6 is a flowchart of a method 600 for providing a cooling system for an engine in accordance with one embodiment. The method 600 may be used to retrofit or convert an existing cooling system of an engine into one or more embodiments of the cooling system 100 (shown in FIG. 1). For example, the method 600 may be used to retrofit an existing cooling system of a diesel engine of a locomotive or other vehicle into the cooling system 100.

At 602, a drain valve is provided. For example, the drain valve 106 (shown in FIG. 1) may be provided in a position that is relatively easy to access by a human operator without additional lifting equipment to lift the operator to a position where he or she can access the drain valve 106. The drain valve 106 may be placed inside of the interior compartment 302 (shown in FIG. 3) of the rail vehicle 300 (shown in FIG. 3) such that the drain valve 106 cannot be easily tampered with, but is still accessible to the human operator without need for a ladder or crane to lift the operator up from the walkway 304 (shown in FIG. 3) to reach the drain valve 106.

At 604, the drain valve is fluidly coupled with a coolant tank using a tank conduit. For example, the drain valve 106 (shown in FIG. 1) may be joined with the tank conduit 110, such as a hose. The tank conduit 110 may be joined with the coolant tank 102 (shown in FIG. 1). The tank conduit 110 fluidly couples the drain valve 106 with the coolant tank 102 in one embodiment.

At 606, the drain valve is fluidly coupled with one or more heat exchangers using radiator conduits and/or an intervening conduit. For example, the drain valve 106 (shown in FIG. 1) may be joined with the radiator conduit 108A (shown in FIG. 1), such as a hose, which is then joined with at least one of the heat exchangers 104 (shown in FIG. 1). The intervening conduit 114 (shown in FIG. 1) may then be coupled to each of a plurality of the heat exchangers 104 to fluidly couple the drain valve 106 with the heat exchangers 104 via the radiator conduit 108A and the intervening conduit 114. Another radiator conduit 108B may be joined with at least one of the heat exchangers 104 with the coolant tank 102 to fluidly couple the coolant tank 102 with the heat exchangers 104.

At 608, the drain valve is fluidly coupled with an external outlet using a drain conduit. For example, the drain valve 106 (shown in FIG. 1) may be joined with the drain conduit 112 (shown in FIG. 1), such as a hose. The drain conduit 112 may include an outlet that provides the outlet 116 (shown in FIG. 1). The outlet 116 may be an external outlet of the cooling system that discharges coolant out of the cooling system.

Figure 7:
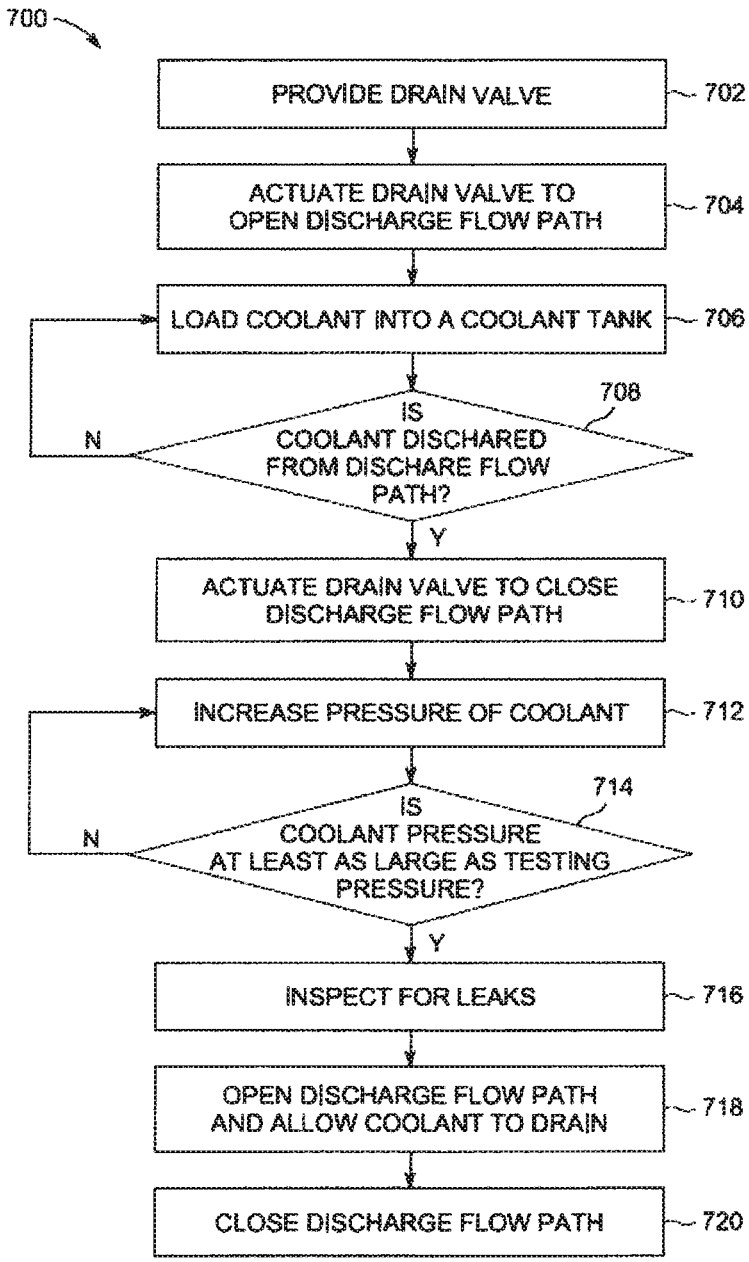
FIG. 7 is a flowchart of a method for testing for a leak in a cooling system in accordance with one embodiment.

FIG. 7 is a flowchart of a method 700 for testing for a leak in a cooling system in accordance with one embodiment. The method 700 may be used to test for leaks in the cooling system 100 shown in FIG. 1.

At 702, a drain valve is provided. The drain valve is fluidly coupled with one or more heat exchangers and a coolant tank. For example, the drain valve 106 (shown in FIG. 1) may be provided. The drain valve 106 may be a three-way valve, another valve, or a set of valves that open and close the second flow path 204 (shown in FIG. 2) to the outlet 116 (shown in FIG. 1) while keeping the first flow path 202 (shown in FIG. 2) to the engine 200 (shown in FIG. 2) open. The drain valve 106 is fluidly coupled with the heat exchangers 104 (shown in FIG. 1) and the coolant tank 102 (shown in FIG. 1) by one or more conduits, such as the conduits 108, 110, 114 (shown in FIG. 1). The drain valve 106 is fluidly coupled with the external outlet 116 (shown in FIG. 1) by the drain conduit 112 (shown in FIG. 1).

At 704, the drain valve is actuated to open a discharge flow path. For example, the handle 500 (shown in FIG. 5) may be rotated in a counter-clockwise direction to the position shown in FIG. 5 to open the discharge flow path 204 (shown in FIG. 2). The opened second flow path 204 provides a fluid flow path that extends through the drain valve 106 (shown in FIG. 1) and connects the heat exchangers 104 (shown in FIG. 1) with the external outlet 116 (shown in FIG. 1). Coolant in the heat exchangers 104 may drain out of the heat exchangers 104 and out of the cooling system 100 (shown in FIG. 1) via the second flow path 204.

At 706, additional coolant is loaded into the coolant tank. For example, the inlet 208 (shown in FIG. 2) of the coolant tank 102 (shown in FIG. 1) may be opened and water or another fluid coolant is loaded into the coolant tank 102.

At 708, a determination is made as to whether at least some of the coolant is discharged from the discharge flow path as the additional coolant is loaded into the coolant tank. For example, an operator may determine if some of the coolant is flowing out of the external outlet 116 (shown in FIG. 1) from the second flow path 204 (shown in FIG. 2). If coolant is flowing out of the second flow path to the outlet, then the flow of coolant indicates that the coolant tank is filled or substantially filled with the coolant. For example, the coolant may have filled the coolant tank and the conduits (such as the tank conduit 110 (shown in FIG. 1)) that couples the coolant tank with the drain valve and the drain conduit such that excess coolant flows out of the coolant tank, through the drain valve, and out of the cooling system through the second flow path 204. As a result, flow of the method 700 continues to 710.

On the other hand, if coolant is not discharged from the discharge flow path, such as by flowing through the outlet 116 (shown in FIG. 1), then the lack of coolant discharge may indicate that the heat exchanger is not filled or substantially filled with the coolant. As a result, flow of the method 700 returns to 706 where additional coolant is loaded into the coolant tank.

At 710, the drain valve is actuated to close the second flow path to the outlet. For example, the drain valve 106 (shown in FIG. 1) may be actuated to close the second flow path 204 (shown in FIG. 2). In one embodiment, the handle 500 (shown in FIG. 5) of the drain valve 106 may be rotated in a clockwise direction from the position shown in FIG. 5 to close the second flow path 204.

At 712, pressure of the coolant in the cooling system is increased. For example, the pressure of coolant in one or more of the conduits 108, 110, 112, 114 (shown in FIG. 1), the heat exchangers 104 (shown in FIG. 1), the drain valve 106 (shown in FIG. 1), and/or the coolant tank 102 (shown in FIG. 1) is increased. The pressure may be increased by loading coolant into the system 100 (shown in FIG. 1) through the inlet 208 (shown in FIG. 2) such that the coolant is forced through the cooling system 100 and the pressure of the coolant in the cooling system 100 is increased.

At 714, a determination is made as to whether the pressure of the coolant is at least as large as a testing pressure. For example, the pressure of the coolant in the cooling system 100 (shown in FIG. 1) may be determined by one or more sensors or gauges disposed along the first flow path 202 (shown in FIG. 2). The pressure of the coolant may be increased to a predetermined testing pressure that exceeds the pressure that the coolant normally is provided during operation of the rail vehicle 300 (shown in FIG. 3) in one embodiment.

If the coolant pressure is at least as large as the testing pressure, then the cooling system is in an overpressure condition. The overpressure condition can be used to test the structural integrity of seals, conduits, and components of the supply flow path. For example, the overpressure condition can stress the conduits 108, 110, 114 (shown in FIG. 1), interfaces between the conduits 108, 110, 114 and the coolant tank 102 (shown in FIG. 1), the drain valve 106 (shown in FIG. 1), and/or the heat exchangers 104 (shown in FIG. 1) to determine if the components and/or interfaces fail during the overpressure condition. If the supply flow path is in the overpressure condition, flow of the method 700 proceeds to 716.

If the coolant pressure is not as large as the testing pressure and the cooling system is not in the overpressure condition, flow of the method 700 returns to 712 where the coolant pressure is increased, such as by increasing the flow of coolant in the cooling system.

At 716, the cooling system is inspected for leaks of the coolant. The cooling system may be maintained at the overpressure condition for a predetermined time period before inspecting for the leaks. For example, the coolant pressure in the cooling system may be held at a pressure that is at least as large as the testing pressure for one or more hours before inspecting for leaks. The presence of leaks may be determined by visual inspection of a human operator and/or using moisture sensors, for example.

At 718, the flow path to the outlet of the cooling system is opened to permit excess coolant to drain from the cooling system. For example, the drain valve 106 (shown in FIG. 1) may be actuated to open the second flow path 204 (shown in FIG. 2) and allow at least some of the coolant to flow through the drain conduit 112 (shown in FIG. 1) and out of the cooling system 100 (shown in FIG. 1) through the outlet 116 (shown in FIG. 1). The coolant pressure may be reduced by the coolant flowing out through the outlet 116.

At 720, the flow path to the outlet is closed. For example, the drain valve 106 (shown in FIG. 1) may be actuated to close the second flow path 204 (shown in FIG. 2). The second flow path 204 can be closed following the leak inspection to prevent coolant from discharging out of the cooling system 100 (shown in FIG. 1) while the cooling system 100 is used to cool a device, such as the engine 200 (shown in FIG. 2) of the rail vehicle 300 (shown in FIG. 3). The cooling system 100 may then be used during operation of the rail vehicle 300 to cool the engine 200 and/or other components of the rail vehicle 300.

In accordance with one embodiment, a cooling system for an engine is provided. The cooling system includes a coolant tank, a heat exchanger, and a drain valve. The coolant tank is configured to hold a fluid coolant and is coupled with a tank conduit through which the coolant flows from or to the coolant tank. The heat exchanger is fluidly coupled with a supply conduit. The drain valve is fluidly coupled with the coolant tank by the tank conduit and with the heat exchanger by the supply conduit. The drain valve is fluidly coupled with a drain conduit that directs the coolant out of the cooling system and is configured to alternate between a closed position and an open position. The drain valve prevents the coolant from flowing out of the cooling system through the drain conduit when the drain valve is in the closed position and permits the coolant to flow from the heat exchanger and out of the cooling system through the drain conduit when the drain valve is in the open position.

In another aspect, the drain valve is disposed between the coolant tank and the heat exchanger along a flow path that fluidly couples the coolant tank with the heat exchanger and is at least partially formed by the tank conduit and the supply conduit.

In another aspect, the drain valve is fluidly coupled with an outlet of the cooling system by the drain conduit. The drain valve may be disposed between the outlet and the heat exchanger along a flow path that is at least partially formed by the supply conduit and the drain conduit.

In another aspect, the coolant tank is disposed lower than the drain valve such that the tank conduit slopes downward from the drain valve to the coolant tank.

In another aspect, the heat exchanger is disposed above the drain valve such that the supply conduit slopes downward from the heat exchanger to the drain valve.

In another aspect, the drain valve is fluidly coupled with an outlet of the cooling system by the drain conduit, the drain valve disposed above the outlet such that the drain conduit slopes downward from the drain valve toward the outlet.

In another aspect, the drain valve also permits the coolant to flow along a pathway between the heat exchanger and the coolant tank when the drain valve is the closed position.

In another aspect, the drain valve includes a handle configured to be manually actuated to switch the drain valve between the open and closed positions. The handle may be positioned within a compartment that holds the drain valve such that the handle prevents the drain valve from being moved to the open position when the compartment is closed to at least partially enclose the drain valve.

In another aspect, the drain valve is accessible by a human operator through one or more of opposite lateral sides of a rail vehicle that includes the heat exchanger.

In another aspect, the heat exchanger is fluidly coupled with the coolant tank by a radiator conduit.

In another embodiment, a method of providing a cooling system for an engine is provided. The method includes fluidly coupling a drain valve with a coolant tank that is capable of holding a fluid coolant and fluidly coupling the drain valve with a heat exchanger. The method further includes fluidly coupling the drain valve with an outlet for directing the coolant away from the coolant tank and the heat exchanger. The drain valve is configured to alternate between a closed position and an open position. The drain valve prevents the coolant from flowing to the outlet when the drain valve is in the closed position and permits the coolant to flow from the heat exchanger to the outlet when the drain valve is in the open position.

In another aspect, at least one of the steps of fluidly coupling the drain valve with the coolant tank or fluidly coupling the drain valve with the heat exchanger comprises positioning the drain valve between the coolant tank and the heat exchanger along a flow path that fluidly couples the coolant tank with the heat exchanger.

In another aspect, the step of fluidly coupling the drain valve with the outlet comprises positioning the drain valve between the outlet and the coolant tank along a first fluid flow path that extends from the coolant tank to the outlet and positioning the drain valve between the outlet and the heat exchanger along a second fluid flow path that extends from the heat exchanger to the outlet.

In another aspect, the step of fluidly coupling the drain valve with the coolant tank comprises joining a tank conduit with the drain valve and the coolant tank such that the tank conduit slopes downward from the drain valve to the coolant tank.

In another aspect, the step of fluidly coupling the drain valve with the heat exchanger comprises joining a supply conduit with the drain valve and the heat exchanger such that the supply conduit slopes downward from the heat exchanger to the drain valve.

In another aspect, a method of testing for a leak in a cooling system of an engine is provided. The method includes actuating a drain valve that is fluidly coupled with a coolant tank, a heat exchanger, and an outlet that directs a coolant out of the cooling system. The drain valve may be actuated to open a discharge flow path that fluidly couples the heat exchanger and the outlet. The method also includes loading the coolant into the coolant tank until at least some of the coolant is discharged from the heat exchanger and through the discharge flow path to the outlet and actuating the drain valve to close the discharge flow path. The method also includes inspecting the cooling system for one or more leaks of the coolant.

In another aspect, at least one of the steps of actuating the drain valve includes maintaining an open flow path that fluidly couples the coolant tank and the heat exchanger by way of the drain valve.

In another aspect, the method also includes increasing a fluid pressure of the coolant to a predetermined testing pressure before the inspecting step.

In another aspect, the inspecting step includes maintaining the fluid pressure of the coolant at the testing pressure.

In another aspect, the inspecting step includes inspecting a flow path for the one or more leaks, where the flow path fluidly couples the coolant tank and the heat exchanger and extending through the drain valve.

Another embodiment relates to a testing system for an engine coolant circuit in a locomotive or other rail vehicle having an engine. In at least one operational mode of the rail vehicle, the engine coolant circuit comprises a fluid pathway extending from a coolant tank to the engine to a radiator system and back to the coolant tank. The rail vehicle includes a pump for moving coolant through the circuit. The testing system includes a drain valve in fluid communication with the fluid pathway of the coolant circuit. The drain valve is configured for selective actuation between a first position, where coolant can flow out of the coolant circuit through the drain valve, and a second position, wherein coolant cannot flow out of the coolant circuit through the drain valve.

In another embodiment, the drain valve of the testing system is positioned in the coolant circuit between the radiator system and the coolant tank.

In another embodiment, the radiator system includes at least one radiator or other heat exchanger, which is positioned higher on the rail vehicle than the coolant tank. The drain valve of the testing system is positioned in the coolant circuit between the at least one radiator or other heat exchanger and the coolant tank.

In another embodiment, the radiator system includes at least one radiator or other heat exchanger, which is positioned higher on the rail vehicle than the coolant tank. Each of the at least one radiator is an inclined radiator located at a top of a cab/compartment of the rail vehicle; "inclined" means a primary plane defined by the radiator is oriented at forty-five degrees or less with respect to a longitudinal axis of the rail vehicle. The drain valve of the testing system is positioned in the coolant circuit between the at least one radiator and the coolant tank.

In any of the aforementioned embodiments of the testing system, the drain valve of the testing system may be positioned for unassisted access by a physically average human operator. "Unassisted access" means (i) no parts of the rail vehicle have to be detached to access the drain valve, and (ii) the operator can grasp an actuator of the drain valve when the operator is situated on the ground, or the operator can grasp an actuator of the drain valve when the operator is situated on a side walkway or other designated operator location of the rail vehicle.

In any of the aforementioned embodiments of the testing system, the drain valve of the testing system may be positioned in the coolant circuit such that actuation of the valve to the first position, where coolant can flow out of the coolant circuit through the drain valve, cannot result in all the coolant in the coolant circuit exiting the coolant circuit. That is, the drain valve is positioned elsewhere than at a location where a valve might be positioned for draining all the coolant out of the coolant circuit.

Another embodiment relates to a method of retrofitting an engine coolant system in a locomotive or other rail vehicle. The engine coolant system comprises a radiator and a coolant tank. The radiator and coolant tank are interconnected by a fluid conduit, by which fluid can pass from the radiator to the coolant tank. The method comprises removing the fluid conduit from at least one of the radiator and coolant tank. The method further comprises disposing a valve between the radiator and coolant tank, and fluidly connecting the valve to the coolant tank and radiator. The drain valve is configured for selective actuation between a first position, where coolant can flow out of the coolant system through the drain valve, and a second position, wherein coolant cannot flow out of the coolant system through the drain valve.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter disclosed herein without departing from its scope. While the dimensions and types of materials described herein are intended to define the parameters of the one or more embodiments of the subject matter, they are by no means limiting and are exemplary embodiments. Many other embodiments will be apparent to one of ordinary skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the described subject matter, including the best mode, and also to enable one of ordinary skill in the art to practice the embodiments disclosed herein, including making and using any devices or systems and performing the methods. The patentable scope of the subject matter is defined by the claims, and may include other examples that occur to one of ordinary skill in the art. Such other examples are within the scope of the claims if they have structural elements that do not differ from the literal language of the claims, or if they include equivalent structural elements with insubstantial differences from the literal language of the claims.

The foregoing description of certain embodiments of the disclosed subject matter will be better understood when read in conjunction with the appended drawings. To the extent that the figures illustrate diagrams of the functional blocks of various embodiments, the functional blocks are not necessarily indicative of the division between hardware circuitry. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Unless explicitly stated to the contrary, embodiments "comprising," "including," or "having" an element or a plurality of elements having a particular property may include additional such elements not having that property.

What is claimed is:

1. A cooling system for an engine, the cooling system comprising:

a coolant tank configured to hold a fluid coolant and coupled with a tank conduit through which the coolant flows into the coolant tank;

a heat exchanger fluidly coupled with a supply conduit through which the coolant flows at least one of into or out of the heat exchanger, the heat exchanger also fluidly coupled with a radiator conduit through which the coolant flows out of the heat exchanger to the coolant tank, the heat exchanger disposed above the coolant tank in a rail vehicle that includes the engine, along a top side of the rail vehicle, and between opposite lateral exterior walls of the rail vehicle, the heat exchanger exposed to ambient air along the top side of the rail vehicle; and a drain valve fluidly coupled with the coolant tank by the tank conduit and with the heat exchanger by the supply conduit, the drain valve disposed above the coolant tank and beneath the heat exchanger in the rail vehicle, the drain valve accessible through a window in at least one of the lateral exterior walls of the rail vehicle and above a walkway extending outside of and along the at least one of the lateral exterior walls so that a human operator can access the drain valve through the window in the at least one of the lateral exterior walls while the human operator stands on the walkway, the drain valve fluidly coupled with a drain conduit that directs the coolant out of the cooling system, the drain valve configured to alternate between a closed position and an open position, wherein the fluid flows from the heat exchanger to the coolant tank through the radiator conduit and from the heat exchanger to the coolant tank via the supply conduit, the drain valve, and the tank conduit when the drain valve is in the closed position, and wherein the fluid flows from the heat exchanger and out of the cooling system through the supply conduit, the drain valve, and the drain conduit when the drain valve is in the open position, further wherein the drain valve prevents the fluid from flowing from the heat exchanger to the coolant tank via the supply conduit, the drain valve, and the tank conduit when the drain valve is in the open position.

2. The cooling system of claim 1, wherein the drain valve is disposed between the coolant tank and the heat exchanger along a flow path that fluidly couples the coolant tank with the heat exchanger and is at least partially formed by the tank conduit and the supply conduit.

3. The cooling system of claim 1, wherein the drain valve is fluidly coupled with an outlet of the cooling system by the drain conduit, the drain valve disposed between the outlet and the heat exchanger along a flow path that is at least partially formed by the supply conduit and the drain conduit.

4. The cooling system of claim 1, wherein the coolant tank is disposed lower than the drain valve such that the tank conduit slopes downward from the drain valve to the coolant tank.

5. The cooling system of claim 1, wherein the heat exchanger is disposed above the drain valve such that the supply conduit slopes downward from the heat exchanger to the drain valve.

6. The cooling system of claim 1, wherein the drain valve is fluidly coupled with an outlet of the cooling system by the drain conduit, the drain valve disposed above the outlet such that the drain conduit slopes downward from the drain valve toward the outlet.

7. The cooling system of claim 1, wherein the drain valve also permits the coolant to flow along a pathway between the heat exchanger and the coolant tank when the drain valve is the closed position.

8. The cooling system of claim 1, wherein the drain valve includes a handle configured to be manually actuated to switch the drain valve between the open and closed positions, the handle positioned within a compartment that holds the drain valve such that the handle prevents the drain valve from being moved to the open position when the compartment is closed to at least partially enclose the drain valve.

9. A method of providing a cooling system for an engine, the method comprising:

fluidly coupling a drain valve to a coolant tank with a tank conduit, the coolant tank capable of holding a fluid coolant, the drain valve disposed above the coolant tank and below a heat exchanger that is located above the coolant tank in a rail vehicle that includes the engine, along a top side of the rail vehicle where the heat exchanger is exposed to ambient air, and between lateral exterior walls of the rail vehicle, the drain valve coupled to the tank conduit such that the drain valve is accessible by a human operator through a window in at least one of the lateral exterior walls of the rail vehicle and above a walkway extending outside of and along the at least one of the lateral exterior walls while the operator stands on the walkway;

fluidly coupling the drain valve to a heat exchanger with a supply conduit, the heat exchanger and the coolant tank fluidly coupled with each other by a radiator conduit; and fluidly coupling the drain valve to an outlet with a drain conduit for directing the coolant out of the cooling system away from the coolant tank and the heat exchanger, wherein the drain valve is configured to alternate between a closed position and an open position, the fluid flowing from the heat exchanger to the coolant tank through the radiator conduit and from the heat exchanger to the coolant tank via the supply conduit, the drain valve, and the tank conduit when the drain valve is in the closed position, the fluid flowing from the heat exchanger and out of the cooling system through the supply conduit, the drain valve, and the drain conduit when the drain valve is in the open position, the drain valve preventing the fluid from flowing from the heat exchanger to the coolant tank via the supply conduit, the drain valve, and the tank conduit when the drain valve is in the open position.

10. The method of claim 9, wherein at least one of the steps of fluidly coupling the drain valve with the coolant tank or fluidly coupling the drain valve with the heat exchanger comprises positioning the drain valve between the coolant tank and the heat exchanger along a flow path that fluidly couples the coolant tank with the heat exchanger.

11. The method of claim 9, wherein the step of fluidly coupling the drain valve with the outlet comprises positioning the drain valve between the outlet and the coolant tank along a first fluid flow path that extends from the coolant tank to the outlet and positioning the drain valve between the outlet and the heat exchanger along a second fluid flow path that extends from the heat exchanger to the outlet.

12. The method of claim 9, wherein the step of fluidly coupling the drain valve with the coolant tank comprises joining the tank conduit with the drain valve and the coolant tank such that the tank conduit slopes downward from the drain valve to the coolant tank.

13. The method of claim 9, wherein the step of fluidly coupling the drain valve with the heat exchanger comprises joining the supply conduit with the drain valve and the heat exchanger such that the supply conduit slopes downward from the heat exchanger to the drain valve.

14. The cooling system of claim 8, wherein an interference bracket disposed within the window of the at least one of the lateral exterior walls encloses the drain valve within the at least one of the lateral exterior walls of the rail vehicle that includes the cooling system, and wherein the handle of the drain valve is rotated to switch between the open and closed positions, the handle positioned to engage the interference bracket and prevent the interference bracket from coupling with the lateral exterior side of the rail vehicle and enclosing the drain valve within the at least one of the lateral exterior walls of the rail vehicle when the drain valve is in the open position, the handle positioned to avoid engagement with the interference bracket and allow the interference bracket to enclose the drain valve within the lateral exterior side of the rail vehicle when the drain valve is in the closed position.

15. The method of claim 9, wherein the drain valve includes a handle configured to be manually actuated to switch the drain valve between the open and closed positions, the handle positioned within a compartment in the window of the at least one of the lateral exterior walls, the compartment holding the drain valve such that the handle prevents the drain valve from being moved to the open position when the compartment is closed to at least partially enclose the drain valve, further comprising positioning an interference bracket in the window of the at least one of the lateral exterior walls to enclose the drain valve within the at least one of the lateral exterior walls of the rail vehicle that includes the cooling system, wherein the handle of the drain valve is rotated to switch between the open and closed positions, the handle positioned to engage the interference bracket and prevent the interference bracket from coupling with the lateral exterior side of the rail vehicle and enclosing the drain valve within the at least one of the lateral exterior walls of the rail vehicle when the drain valve is in the open position, the handle positioned to avoid engagement with the interference bracket and allow the interference bracket to enclose the drain valve within the at least one of the lateral exterior walls of the rail vehicle when the drain valve is in the closed position.

* * * * *